US007137437B2

(12) United States Patent
Zajber et al.

(10) Patent No.: US 7,137,437 B2
(45) Date of Patent: Nov. 21, 2006

(54) METHOD AND DEVICE FOR PRODUCING CONTINUOUSLY CAST STEEL SLABS

(75) Inventors: Adolf Gustav Zajber, Langenfeld (DE); Dirk Letzel, Ratingen (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 10/543,073

(22) PCT Filed: Jan. 16, 2004

(86) PCT No.: PCT/EP2004/000282

§ 371 (c)(1),
(2), (4) Date: Jul. 21, 2005

(87) PCT Pub. No.: WO2004/065030

PCT Pub. Date: Aug. 5, 2004

(65) Prior Publication Data

US 2006/0054297 A1 Mar. 16, 2006

(30) Foreign Application Priority Data

Jan. 22, 2003 (DE) ..... 103 02 265

(51) Int. Cl.
*B22D 11/00* (2006.01)

(52) U.S. Cl. ..... 164/476; 164/477; 164/452

(58) Field of Classification Search ..... 164/476, 164/477, 417, 452, 154.2, 154.6
See application file for complete search history.

(56) References Cited

U.S. PATENT DOCUMENTS 3,333,452 A 8/1967 Sendzimir
5,657,814 A * 8/1997 Maebara et al. ..... 164/452
5,904,204 A * 5/1999 Teraoka et al. ..... 164/417
6,286,354 B1 * 9/2001 Kajiwara et al. ..... 72/237

FOREIGN PATENT DOCUMENTS

DE 38 22 939 10/1989
DE 38 40 812 4/1990

(Continued)

*Primary Examiner*—Kevin Kerns
*Assistant Examiner*—I.-H. Lin
(74) *Attorney, Agent, or Firm*—Friedrich Kueffner

(57) ABSTRACT

Continuously cast products (12) are often provided with surface defects such as oscillation marks (17) and other non-homogeneous structures in the cast state thereof during production in a casting die (11) of a continuous casting plant (10). Defects which render a strip useless for superior applications also frequently occur on the strip surface during subsequent milling of the slab (12") into a strip. The aim of the invention is to minimize said defects and provide the rolling mill with a slab (12") having a desired preliminary profile and an improved near-surface structure. Said aim is achieved by arranging a reducing roll stand (30) in the area of the bending rolls or straightening driver rolls (24) within the continuous casting plant (10). Said reducing roll stand (30) allows the cast billet (12) to be deformed in a specific manner at an early point in time while still having a high temperature and providing a high energy yield after being completely hardened such that the depth of the existing oscillation marks (17) on the cast billet surface (16) is reduced, the finely crystalline edge layer (18) is enlarged as a result of the energy being released which is introduced into the reducing billet (12') during said deformation process, and increased recrystallization occurs and the grains in the deformed edge zone (19) of the slab (12") are refined during the subsequent thermal treatment in a holding furnace (40).

4 Claims, 4 Drawing Sheets

FOREIGN PATENT DOCUMENTS

| | | | |
|---|---|---|---|
| EP | 0 326 190 | | 8/1989 |
| EP | 1 059 125 | | 12/2000 |
| JP | 2000197953 | * | 7/2000 |
| WO | 99/54072 | | 10/1999 |
| WO | 00/10741 | | 3/2000 |
| WO | 00/20141 | | 4/2000 |

* cited by examiner

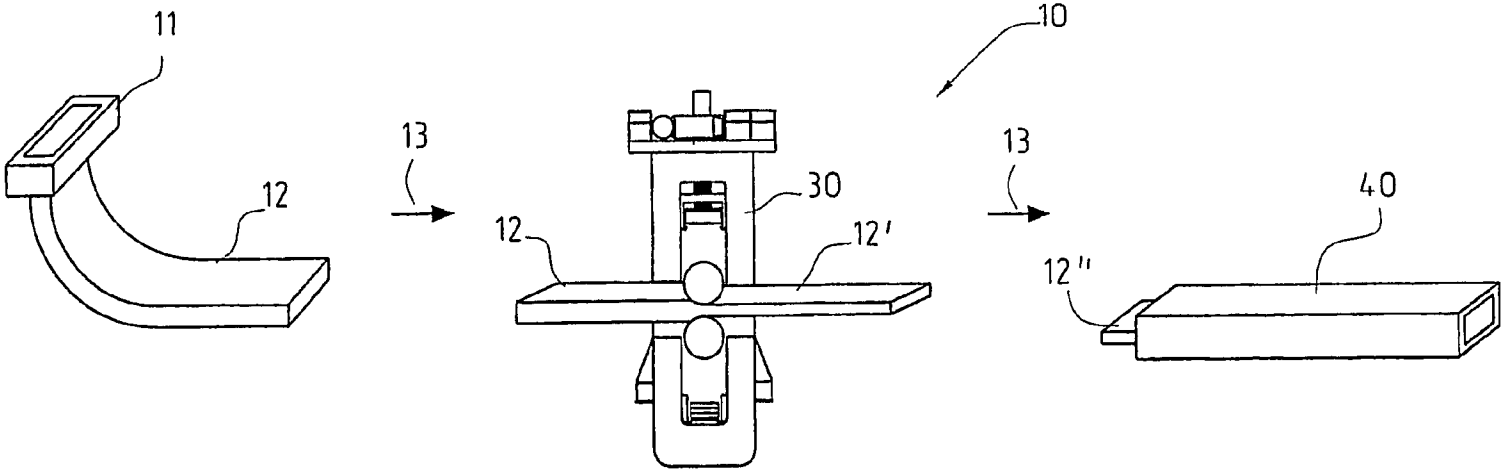
Fig.1
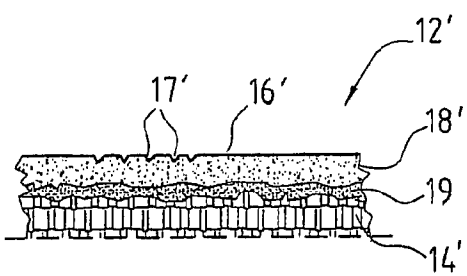
Fig.2a
Fig.2b
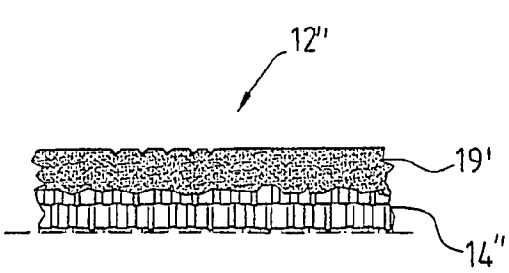
Fig.2c

METHOD AND DEVICE FOR PRODUCING CONTINUOUSLY CAST STEEL SLABS

CROSS-REFERENCE TO RELATED APPLICATION

This application is a 371 of PCT/EP04/00282 filed on Jan. 16, 2004.

BACKGROUND OF THE INVENTION

The invention concerns a method and a device for producing slabs in a continuous casting installation, with an oscillating casting mold and a downstream strand guide below it, in which the cast strand is bent from the vertical casting direction into the horizontal rolling direction and during this process is supported and conveyed by driver rolls, which are arranged opposite each other in pairs, are adjusted relative to each other with well-defined contact force and can be combined into segments, and is deformed by at least one pair of driver rolls to a thickness that is reduced relative to its cast state, after which the continuous preliminary section or the reduced strand is cut into slabs, which are conveyed to a soaking furnace and then to a rolling mill.

So that the cast strand, which is produced in a continuous casting installation with a thickness of less than 100 mm, can be conveyed out of the continuous casting installation, the driver rolls are pressed against the strand with a certain pressure which prevents the driver rolls from slipping through and produces a sufficiently large tensile force on the strand below the point of complete solidification. In the state of the art, this pressure of the driver rolls in the area of complete solidification or locally sooner is utilized to alter the strand thickness, since the rolling forces to be applied are small due to the fact that the cast strand is still soft.

For example, DE 38 22 939 C1 describes a continuous casting method for the production of slabs with a reduced thickness relative to the cast state, in which a strand whose cross section is partially solidified is deformed by rolls that can be hydraulically adjusted relative to each other. These rolls acts to deform the strand both within the solidification section and in the area of the completely solidified strand, and during this process, the strand is deformed from about 60 mm to a final gage of 20 to 15 mm, and at the same time a product with a high proportion of rolling microstructure is produced. In this regard, at least one pair of rolls that acts on the already completely solidified part of the strand can be adjusted against stops to ensure the final dimension of the strand.

DE 198 17 034 A1 describes a method for the continuous casting of thin metal strip in a continuous casting installation with an oscillating, water-cooled mold, in which, directly after the complete solidification of the cast strand, at least one pair of driver rolls is continuously pressed against the strand with a variably defined pressure to achieve a well-defined thickness reduction of at least 2% and to maintain a desired strand thickness that has been adjusted in advance at a constant level.

Finally, EP 0 804 981 B1 describes a continuous casting method and a continuous casting device, in which cast slabs are fed to a large number of reducing installations, each of the reducing installations is assigned a target rolling reduction or a target pressure, and a deformation of a liquid core of the slabs is carried out, such that cast slabs can be produced with increased or decreased thickness compared to the slabs continuously removed from the mold.

In addition to the effort to reduce the thickness of the cast strand inexpensively and with relatively simple means that are already available by using the drivers that are already present, another objective that needs to be pursued is improvement of the surface quality of the slabs that are produced. In their cast state, continuously cast products may have surface defects, such as oscillation marks and other microstructural inhomogeneities. Subsequent rolling of the slab into a strip then results in defects in the strip surface. The effect of oscillation marks in austenitic steels consists essentially in the fact that, at the base of the oscillation marks (in the notch), there is diminished heat dissipation, which results in coarsening of the microstructure and segregation. These are mainly Cr or Mo concentrations. These concentrations lead to the formation of intermetallic phases, which, as the cause of the specified surface defects, must be removed by grinding before the rolling operation is carried out.

The solidification behavior of austenites is characterized by shrinkage during the transformation from ferrite to austenite, which results in a tendency of the strand shell to contract. This contraction can lead to increased delta ferrite concentrations and to poorer hot workability in the affected places. The nonuniform solidification at the surface then causes so-called scale patterns during direct rolling. These negative phenomena also generally have to be eliminated by grinding.

In ferritic steels as well, oscillation marks cause diminished heat dissipation at their base, which results in coarsening of the microstructure and segregation (Ni concentration, hard spots). To obtain a satisfactory final product, these inhomogeneities must also be eliminated by grinding.

The aforementioned surface defects cannot be eliminated by the previously known deformation of the cast strand while it is still soft, since the practical effect is to "knead" especially the oscillation marks that are present more deeply into the soft cast strand.

SUMMARY OF THE INVENTION

Proceeding on the basis of this prior art, the objective of the invention is to specify a simple method and a device based on this method, by means of which the surface working, e.g., grinding, that was previously required can be eliminated.

In accordance with the present invention, which the cast strand, while it is still within the continuous casting installation in the area of the bending or straightening driver rolls after its complete solidification, is deformed by at least one reducing stand at an early point in time, at a temperature that is still so high, and in such a well-defined way with high energy input that

- the depth of the oscillation marks present in the surface of the cast strand is reduced, and
- as a result of the release of the energy introduced into the reduced strand during this deformation, the finely crystalline surface zone is enlarged, and in the subsequent heat treatment in a soaking furnace, increased recrystallization occurs with the grains in the deformed surface zone of the slab becoming finer.

This positive effect of a deformation carried out at an early point in time with high energy input, especially in the surface zone of the cast strand, by which the recrystallization during the subsequent heat treatment in a soaking furnace is favorably influenced and by which the oscillation marks are smoothed down at an early point in time, so that the heat flow over the strand surface can occur uniformly, is preferably obtained at a surface temperature of the cast strand on the order of 1,000° C.

In accordance with the invention, this deformation, by which subsequent surface working, for example, by grinding is reduced to a minimum, is carried out with one or more reducing stands with roll diameters of 600 to 900 mm, and preferably with a roll diameter of 700 mm, for the reduction of a cast strand 50 mm thick by a maximum amount of 7 mm.

To be able to maintain extremely narrow tolerance limits in the hot rolled strip, slabs of very exact geometry are required in the rolling mill. Therefore, to realize an exactly defined slab format, the rolls of the reducing stand are provided with preshaping, and the reducing stand or stands are provided with an automatic gage control system and are connected with the downstream rolling mill for feedback of the rolling parameters to be set. When several reducing stands are used, only a slight reduction of the cast strand with high dimensional accuracy of the desired preliminary section is carried out with the last pair of rolls. These measures then already make it possible to produce a cast strand with exactly adjusted geometric data and improved surface in the continuous casting installation, so that slabs that do not first have to be subjected to expensive surface working can be supplied to the subsequent hot rolling mill.

To carry out the method of the invention, at least one reducing stand is installed within the continuous casting installation in the area of the bending or straightening driver rolls. In this regard, depending on existing spatial conditions, the following items can be provided:

At least one additional reducing stand after the straightening drivers with column or lever construction.

At least one additional reducing stand before the straightening drivers with column or lever construction; realization depends very strongly on spatial conditions (casting radius of the continuous casting installation, point of complete solidification).

Realization of the straightening driver as a combination of straightening driver and reducing stand. In this regard, the surface deformation of the cast strand can be carried out in as many steps as there are pairs of rolls available.

Additional details, features, and advantages of the invention are apparent from the following explanation of the specific embodiments of the invention schematically illustrated in the drawings.

BRIEF DESCRIPTION OF THE DRAWING:

FIG. 1 shows a flow diagram of a continuous casting installation with soaking furnace.

FIGS. 2*a*–2*c* show the microstructural development of the cast strand or the slab during the various process steps of FIG. 1.

Figure 3:
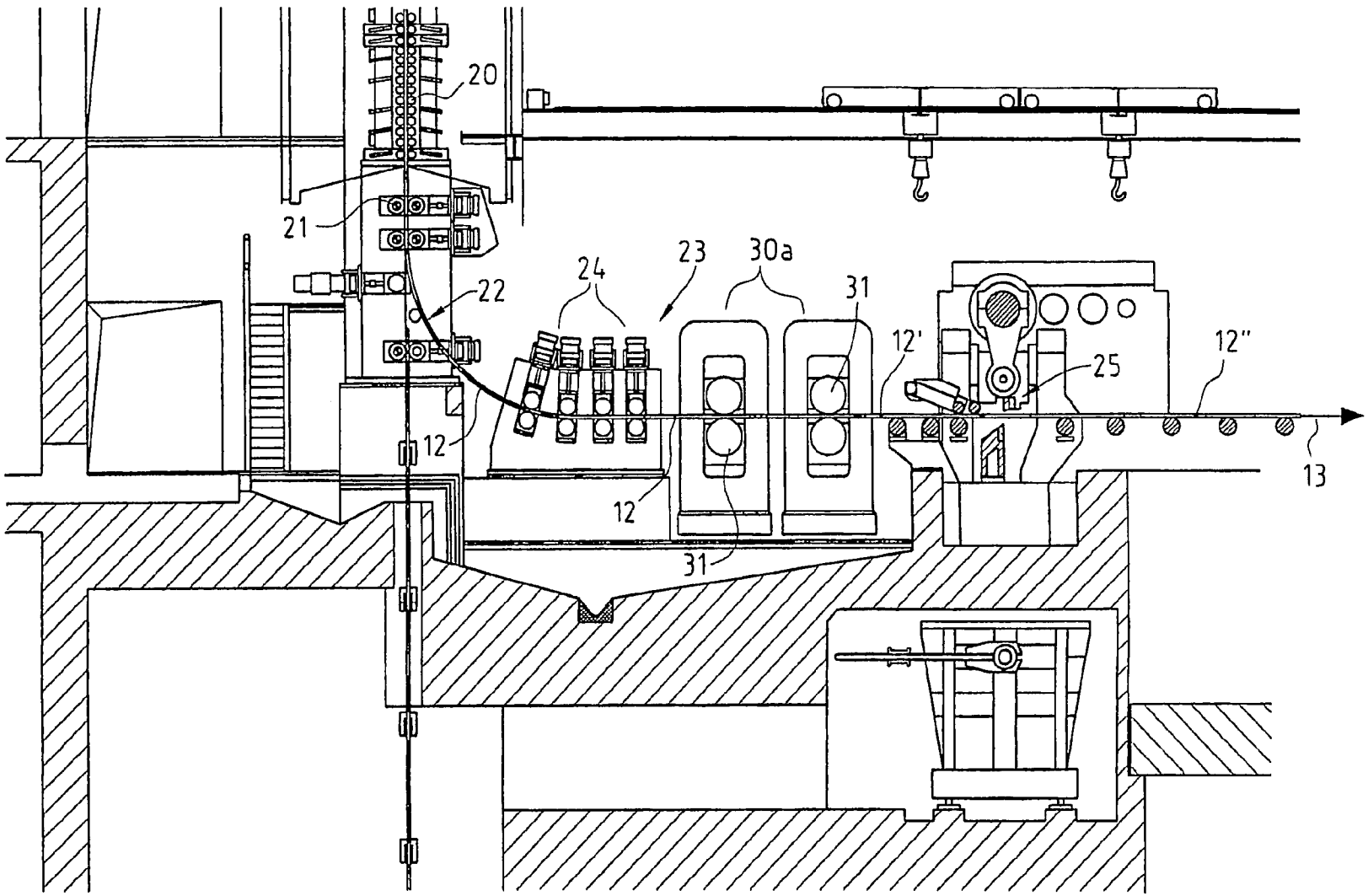
FIG. 3 shows a continuous casting plant with reducing stand with column construction after the straightening drivers.

DETAILED DESCRIPTION OF THE INVENTION:

FIG. 1 shows the process steps that are relevant to the invention in a continuous casting installation, specifically, the production of the cast strand 12 in an oscillating mold 11, deformation of the cast strand 12 in a reducing stand 30 to form a reduced strand 12', and heat treatment of the reduced strand 12', which has been cut into slabs 12", in a soaking furnace 40.

The cast strand 12 that has been produced leaves the oscillating mold 11 in the vertical direction, is bent into the horizontal strand conveyance direction 13, and supplied as a continuous cast strand 12 to a reducing stand 30, where the deformation in accordance with the invention occurs, by which a reduced strand 12' with the desired surface qualities is produced. After separation of the reduced strand 12' into slabs 12", the slabs are subjected to a heat treatment in a soaking furnace 40 before being fed into the rolling mill (the rolling mill is not shown). The microstructural forms of the cast strand or slab that are obtained in each of these various process steps of FIG. 1 are shown schematically in vertical sections in FIGS. 2*a*–2*c*.

The cast strand 12 produced in the mold 11 has a cast microstructure 14 (FIG. 2*a*) with a finely crystalline surface zone 18 produced during the complete solidification of the cast strand 12. The strand surface 16 contains oscillation marks 17, which are represented as notch-like depressions. They were produced during the casting process in the mold and cause, among other things, the aforementioned surface defects during the subsequent rolling process. These oscillation marks 17 were largely smoothed down by the deformation, in accordance with the invention, of the cast strand 12 in the reducing stand 30 to form the thickness-reduced cast strand or reduced strand 12' (FIG. 2*b*), so that now only relatively small depressions 17' are still present in the strand surface 16'. In addition, during this deformation of the cast strand 12, the original finely crystalline structure of the surface zone 18 was partially recrystallized in a small inner zone 19 by the introduction into the deformed surface zone 18' of a higher energy state, whose effect extends as far as the region of the aligned dendrites. During the subsequent heat treatment of the slabs 12" in the soaking furnace 40 (FIG. 2*c*), this recrystallized zone 19 was then able to expand into the completely recrystallized surface zone 19'.

Figure 4:
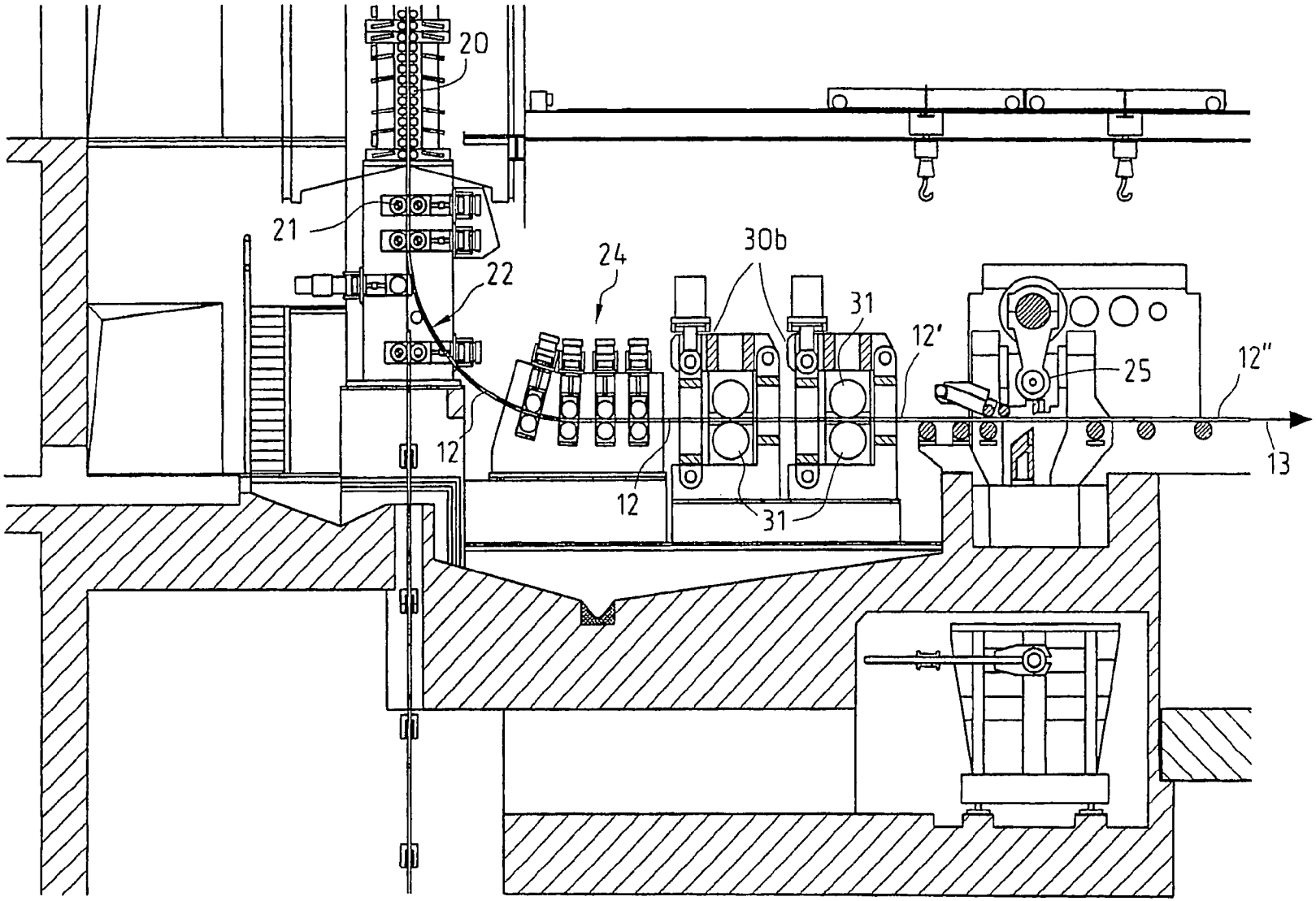
FIG. 4 shows a continuous casting installation with reducing stand with lever construction after the straightening drivers.
Figure 5:
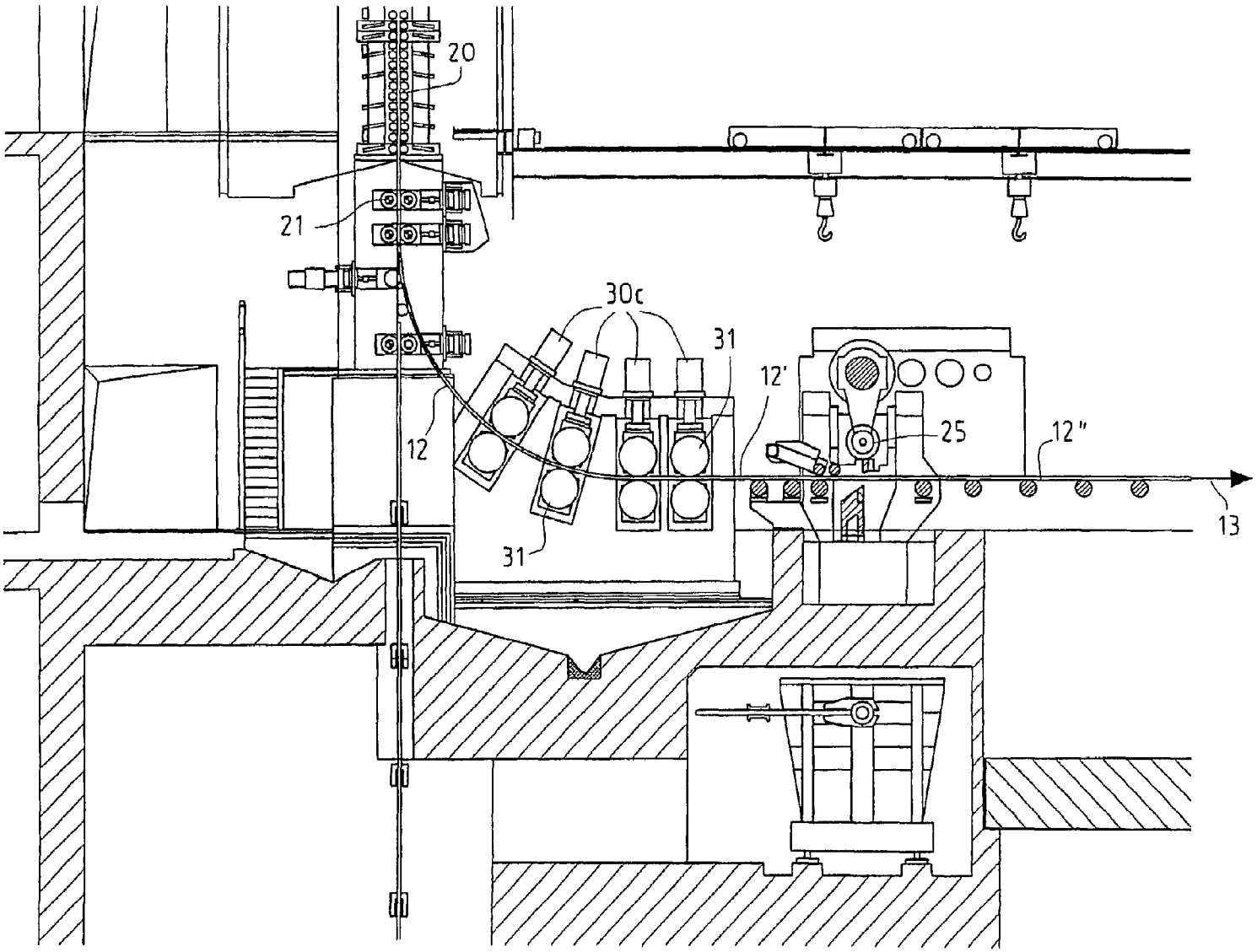
FIG. 5 shows a continuous casting installation with straightening drivers converted to a reducing stand.

In FIGS. 3, 4, and 5, different reducing stands 30 are installed in an existing continuous casting installation 10. For the sake of clarity, each drawing shows the same continuous casting installation 10, and for this reason the same parts of the installation were also provided with the same reference numbers. The cast strand 12 produced in the oscillating mold (not shown here) of the continuous casting installation 10 is initially guided vertically downward. It is supported by pairs of rolls of a vertical strand guide 20 and conveyed by driver rolls 21. In the bending zone 22, the cast strand 12 is bent out of the vertical casting direction into the horizontal conveyance direction 13 and conveyed in the rolling direction in a strand guide 23 by means of straightening drivers 24. A cutting device 25, which is installed some distance from the straightening drivers 24, cuts the cast strand or reduced strand 12' into slabs 12" of the desired length as it passes through. The cutting device 25 is followed by the parts of the installation which were referred to earlier but are no longer shown here, namely, the soaking furnace 40 and rolling mill.

In FIG. 3, two additional reducing stands 30*a* with column construction are installed in the space available between the straightening drivers 24 and the cutting device 25 of the continuous casting plant 10, and the cast strand 12 is deformed into the reduced strand 12' in these reducing stands. The two reducing stands 30*a* are designed significantly larger than the otherwise customary drivers, and their rolls 31 (600–900 mm in diameter in accordance with the invention) are significantly larger in diameter than the rolls of the strand guide. This ensures the desired energy input into the cast strand 12 during the deformation that is carried out with surface smoothing (reduction of the depth of the oscillation marks).

In FIG. 4, two reducing stands 30*b* with lever construction are installed in the same place in the continuous casting installation 10 instead of the reducing stands 30*a* of FIG. 3. Here again, the reducing stands 30*b* and their rolls 31 are dimensioned significantly larger than the otherwise customary drivers of the strand guide.

In FIG. 5, no additional reducing stands are provided in the continuous casting installation 10. The deformation of the cast strand 12 in accordance with the invention is carried out by original straightening drivers 24 that have been converted to a reducing stand 30*c* and that are likewise dimensioned significantly larger than the otherwise customary straightening drivers 24 (see FIGS. 3 and 4).

The invention is not limited to the illustrated embodiments. Thus, the number of reducing stands 30*a*, 30*b* and converted straightening drivers 24 shown in FIGS. 3 to 5 is merely an example and can be suitably varied by one skilled in the art according to the existing local situation. The same is true of the selection of a suitable type of stand construction and the selection of the site of installation of the stands or the selection of a combination of different installation sites within the continuous casting installation, in which case especially the characteristics of the cast strand must also be taken into consideration.

LIST OF REFERENCE NUMBERS

10 continuous casting installation
11 mold
12 cast strand
12' reduced strand
12" slab
13 strand conveyance direction
14, 14', 14' primary cast structure
16, 16' cast strand surface
17, 17' oscillation marks
18, 18' finely crystalline surface zone
19, 19' completely recrystallized surface zone
20 vertical strand guide
21 vertical driver rolls
22 bending zone
23 horizontal strand guide
24 straightening driver
25 cutting device
30 reducing stand
30*a* reducing stand with column construction
30*b* reducing stand with lever construction
30 *c* reducing stand as modified straightening driver
31 rolls of 30
40 soaking furnace

The invention claimed is:

1. Method for producing slabs in a continuous casting installation (10) with an oscillating casting mold (11) and a downstream strand guide (20, 22, 23) below it, comprising the steps of: bending a cast strand (12) from a vertical casting direction into a horizontal rolling direction; supporting and conveying the cast strand during bending by driver rolls (21, 24), which include straightening driver rollers and are arranged opposite each other in pairs, are adjusted relative to each other with well-defined contact force and can be combined into segments; deforming the cast strand (12), while it is still within the continuous casting installation (10) in an area of the straightening driver rolls (24), by at least one reducing stand (30) to a reduced strand (12') with a reduced thickness relative to its cast state; subsequently cutting the reduced strand (12') into slabs (12"); and conveying the slabs to a soaking furnace (40) and then to a rolling mill, the step of deforming the cast strand (12) to the reduced strand (12') is carried out at an early point in time after its complete solidification at a surface temperature on the order of 1,000° C. in such a well-defined way with high energy input and low thickness reduction of, for example, a maximum of 7 mm at a cast strand thickness of 50 mm that the depth of oscillation marks (17) present in a surface (16) of the cast strand is reduced, and as a result of the introduction of the higher energy state into a deformed surface zone (18') of the reduced strand (12'), whose effect extends as far as a region of aligned dendrites, an original finely crystalline structure of the surface zone (18) of the cast strand (12) is partially recrystallized in a small inner zone (19) in such a way that this zone (19) then expands into a completely recrystallized surface zone (19') of the slab (12") in a subsequent heat treatment in the soaking furnace (40).

2. Method in accordance with claim 1, wherein the deforming step is carried out with one or more reducing stands (30) with roll diameters of 600 to 900 mm, and preferably with a roll diameter of 700 mm, for the reduction of a cast strand 50 mm thick by a maximum amount of 7 mm.

3. Method in accordance with claim 1, wherein a desired preliminary section can already be exactly adjusted in the continuous casting installation with the reducing stand (30) by preshaping its rolls (31) and by feedback of the rolling parameters to be set with the downstream rolling mill.

4. Method in accordance with claim 1, wherein, when several reducing stands (30) are used, only a minimal reduction of the cast strand (12) with high dimensional accuracy of a desired preliminary section or reduced strand (12') is carried out with the last pair of rolls (31).

* * * * *